US008096019B2

(12) United States Patent
Lin et al.

(10) Patent No.: US 8,096,019 B2
(45) Date of Patent: Jan. 17, 2012

(54) HINGE DEVICE

(75) Inventors: Wan-Cheng Lin, Taipei Hsien (TW); Zhong-Qun Li, Shenzhen (CN); Zhong-Liang Jian, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 262 days.

(21) Appl. No.: 12/610,384

(22) Filed: Nov. 2, 2009

(65) Prior Publication Data

US 2011/0016668 A1 Jan. 27, 2011

Related U.S. Application Data

(63) Continuation-in-part of application No. 12/546,338, filed on Aug. 24, 2009.

(30) Foreign Application Priority Data

Jul. 23, 2009 (CN) ..... 2009 1 0304756

(51) Int. Cl.
*E05F 1/08* (2006.01)

(52) U.S. Cl. ..... 16/297; 16/335; 16/342

(58) Field of Classification Search ..... 16/297, 16/299, 335, 337, 339, 355, 357, 360, 374, 16/286; 361/679.08, 679.11, 679.02, 679.15, 361/679.27; 455/90.3, 575.1, 575.3, 575.8; 379/433.12, 433.13; 348/373, 333.01, 333.06, 348/794

See application file for complete search history.

(56) References Cited

U.S. PATENT DOCUMENTS

| | | | | | |
|---|---|---|---|---|---|
| 3,608,130 | A * | 9/1971 | Rudnick | ..... | 16/335 |
| 4,069,548 | A * | 1/1978 | Bierlich | ..... | 16/341 |
| 4,584,589 | A * | 4/1986 | Bivins et al. | ..... | 343/882 |
| 4,882,807 | A * | 11/1989 | Frye et al. | ..... | 16/225 |
| 5,815,886 | A * | 10/1998 | Nishio et al. | ..... | 16/360 |
| 6,230,365 | B1 * | 5/2001 | Lu | ..... | 16/342 |
| 6,438,798 | B1 * | 8/2002 | Chene et al. | ..... | 16/335 |
| 6,470,532 | B2 * | 10/2002 | Rude | ..... | 16/335 |
| 6,983,514 | B2 * | 1/2006 | Lu et al. | ..... | 16/342 |
| 7,673,844 | B2 * | 3/2010 | Zhang et al. | ..... | 248/372.1 |
| 7,971,317 | B2 * | 7/2011 | Guo et al. | ..... | 16/307 |

* cited by examiner

*Primary Examiner* — Chuck Y. Mah

(74) *Attorney, Agent, or Firm* — Altis Law Group, Inc.

(57) ABSTRACT

A hinge device includes a first connecting member, a second connecting member, and a locking member. The first connecting member defines a connecting portion hole therein. A positioning arm with an angled surface is located on the first connecting member. The second connecting member defines a connecting body hole therein. A connecting body post is located on the second connecting member. The locking member engages in the connecting portion hole and the connecting body hole so that the first connecting member is rotatable relative to the second connecting member. The connecting body post abuts on the angled surface and the first connecting member is rotated between a first position where a first friction is generated between the connecting body post and the angled surface, and a second position where a second friction is generated between the connecting body post and the angled surface and greater than the first friction.

20 Claims, 6 Drawing Sheets

HINGE DEVICE

CROSS-REFERENCE TO RELATED APPLICATIONS

This application is a continuation-in-part of U.S. patent application Ser. No. 12/546,338, filed on Aug. 24, 2009, titled "HINGE STRUCTURE".

BACKGROUND

1. Technical Field

The present disclosure relates to hinges.

2. Description of Related Art

Usually, electronic devices, such as notebook computers, utilize hinge devices. A hinge device is typically located between a display and a main body of a notebook computer. A spring member is located on the hinge device. The spring member is resiliently deformed when the display is in a closed position, and rebounds to help rotate the display from the closed position to an open position when the notebook computer is opened. However, impact damage due to the rebound of the spring member when the display is open very quickly may eventually reduce the useful life of the notebook computer.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
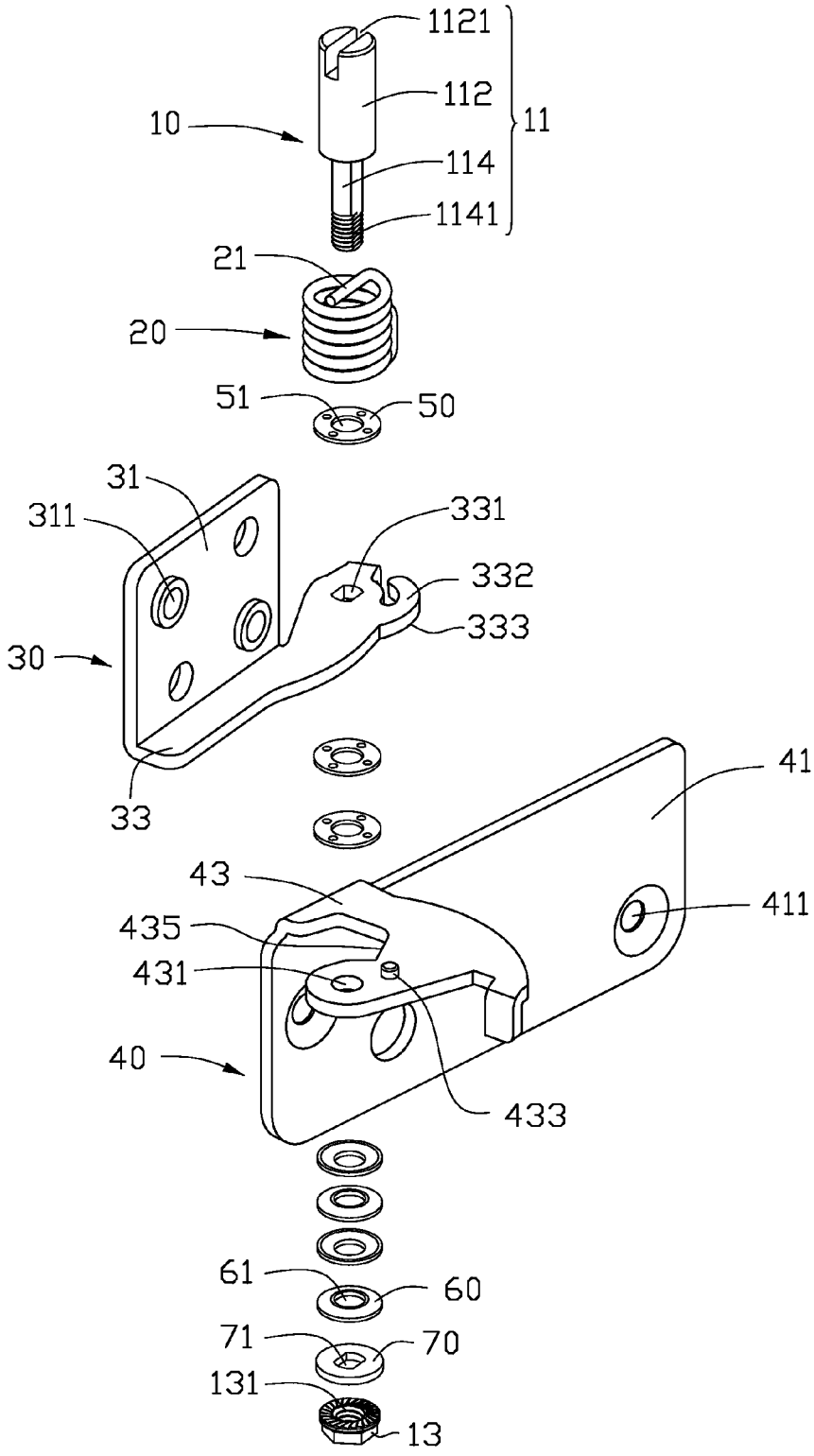
FIG. 1 is an exploded, isometric view of a hinge device in accordance with an embodiment.

Referring to FIG. 1, a hinge device in accordance with an embodiment includes a first connecting member 30, a second connecting member 40, a locking member 10, and a spring member 20.

Figure 2:
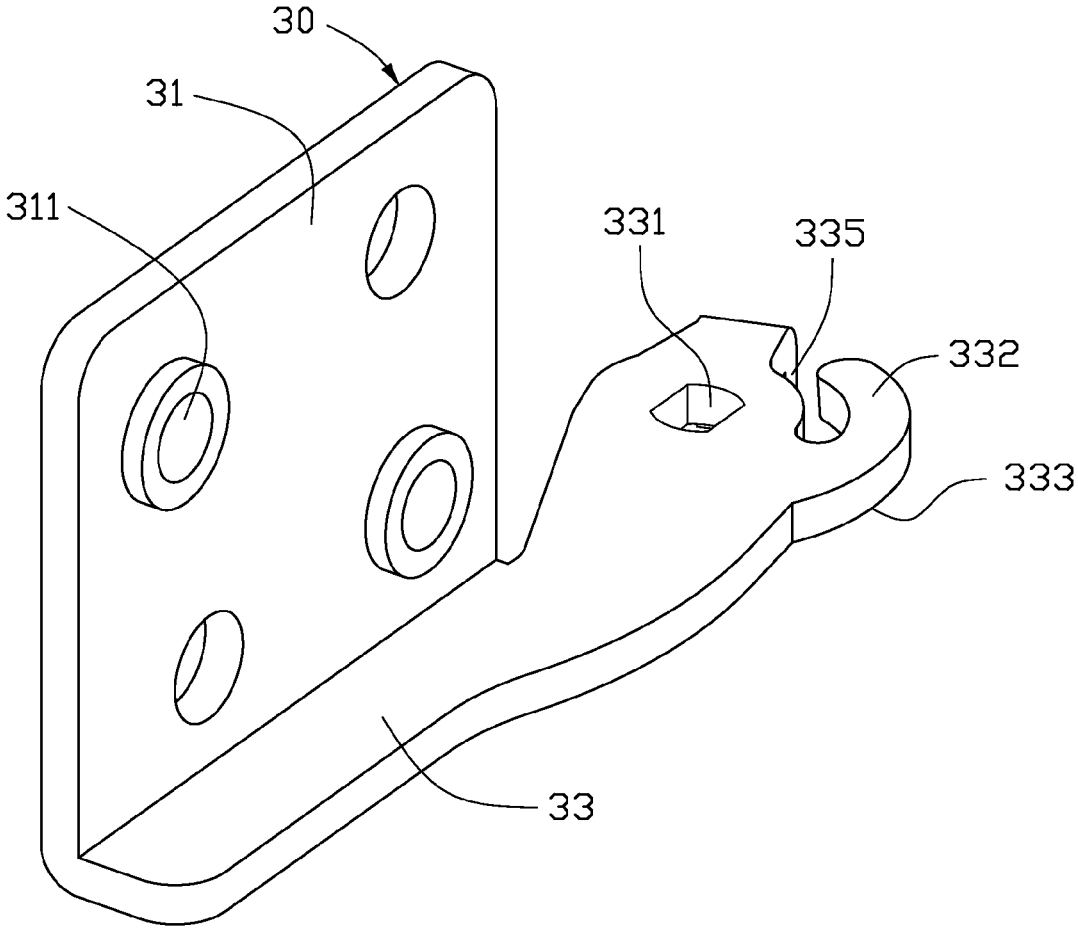
FIG. 2 is an isometric view of a first connecting member of FIG. 1.

Referring to FIGS. 1-2, the first connecting member 30 includes a base portion 31, and a connecting portion 32 extending from a bottom edge of the base portion 31. A plurality of base portion holes 311 is defined in the base portion 31. A connecting portion hole 331 is defined in the connecting portion 33. In one embodiment, the connecting portion hole 331 is substantially rectangular. A resiliently deformable positioning arm 332 extends from the connecting portion 33. The positioning arm 332 has an angled surface 333 relative to a bottom surface of the connecting portion 33. In one embodiment, the positioning arm 332 is arc-shaped. A connecting portion tab 335 (shown in FIG. 2) is bent down from an edge of the connecting portion 33.

Figure 3:
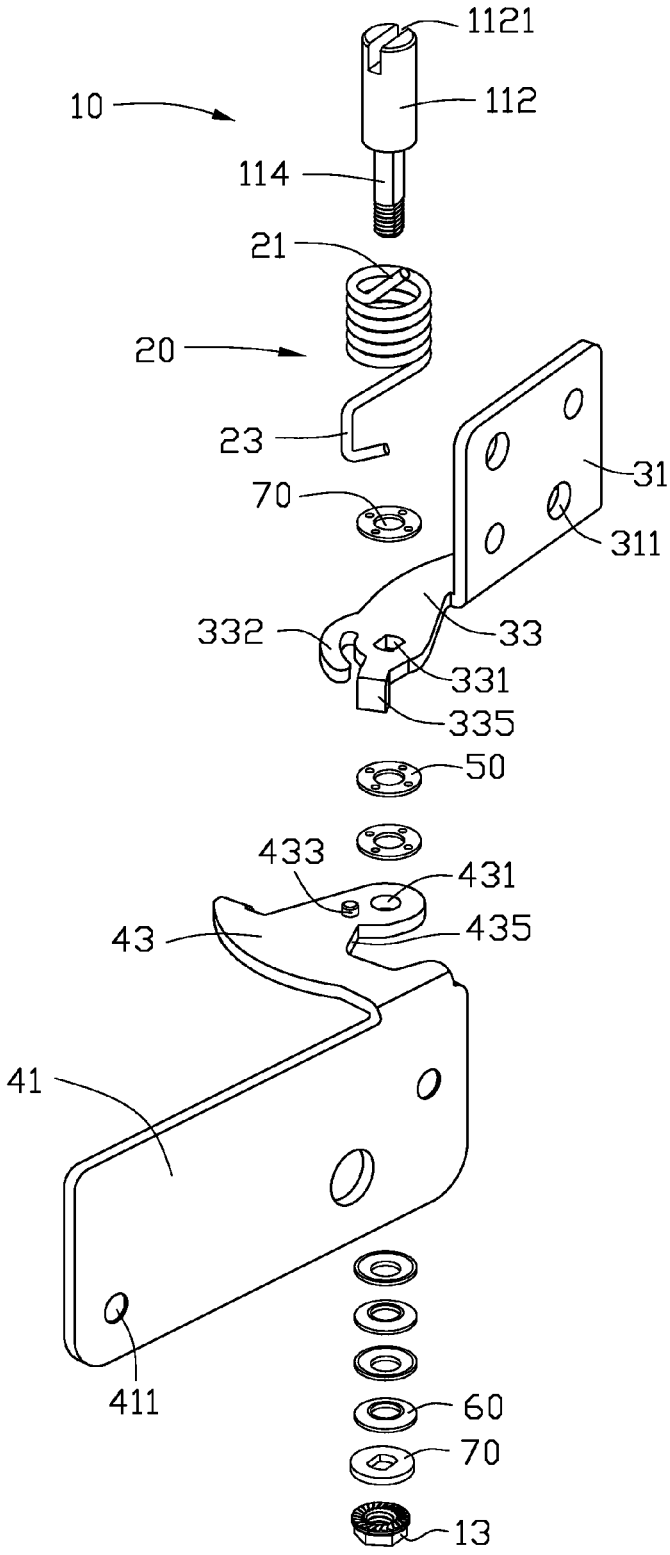
FIG. 3 is similar to FIG. 2, but shown from another aspect.

Referring to FIGS. 1 and 3, the second connecting member 40 includes a base body 41 and a connecting body 43 extending from a top edge of the base body 41. A plurality of base body holes 411 is defined in the base body 41. A connecting body hole 431 is defined in the connecting body 43. A connecting body post 433 is located on a top surface of the connecting body 43, and is configured to engage with the angled surface 333 of the connecting portion 33 of the first connecting member 30. A connecting body cutout 435 is defined in the connecting body 43 adjacent to the connecting body hole 431 and the connecting body post 433, and configured for receiving the connecting portion tab 335 of the first connecting member 30.

The locking member 10 includes a screw part 11 and a nut part 13 extending from the screw part 11. The screw part 11 includes a head 112 and a neck 114 extending from the head 112. A head slot 1121 is defined in the head portion 112. In one embodiment, the head slot 1121 is elongated. The neck 114 is configured to locate in the connecting portion hole 331 of the first connecting member 30 and the connecting body hole 431 of the second connecting member 40. In one embodiment, a cross section of the neck 114 is substantially rectangular. A thread portion 1141 is disposed on the neck 114. The nut part 13 defines a threaded hole 131 for engaging with the thread portion 1141 of the neck 114.

The spring member 40 includes a first end 21 and a second end 23 (shown in FIG. 3). The first end 21 is configured to be located in the head slot 1121 of the locking member 10. The second end 23 is configured to engage in the connecting body cutout 435 of the second connecting member 40. The spring member 40 is configured to be deformable when torque is applied to the first end 21 and/or the second end 23.

Referring to FIG. 1, the hinge device further includes three first spacer pieces 50, four second spacer pieces 60, and a third spacer piece 70. A first through hole 51 is defined in each first piece 50. A second through hole 61 is defined in each second piece 60. A third through hole 71 is defined in the third piece 70. In one embodiment, the third through hole 71 is substantially rectangular.

Figure 4:
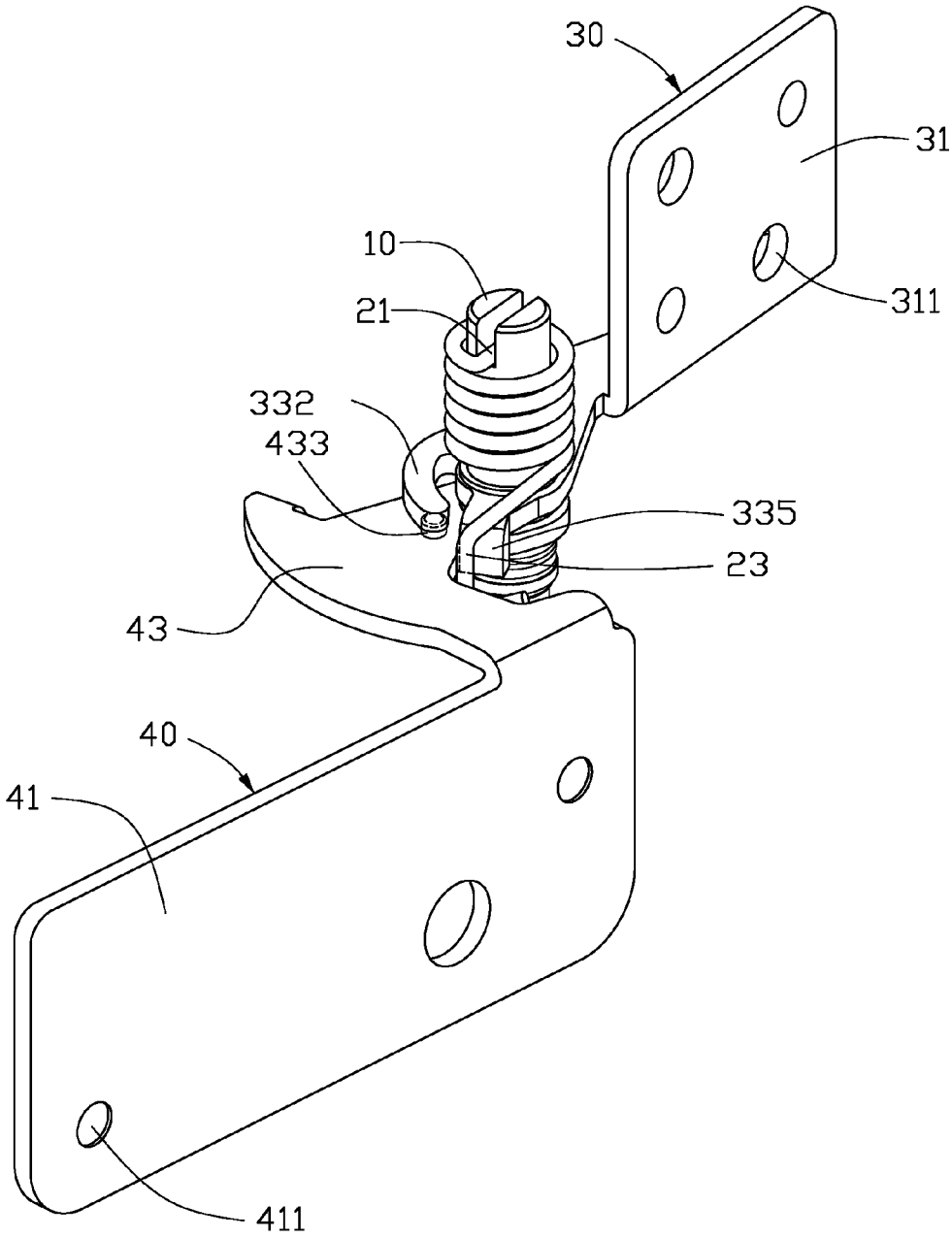
FIG. 4 is an assembled view of the hinge device of FIG. 3, showing a connecting body post in a first position.

Referring also to FIGS. 1 and 4, in assembly of the hinge device, the neck 114 of the locking member 10 is extended in turn through the first through hole 51 of one first piece 50, the connecting portion hole 331 of the first connecting member 30, the first through holes 51 of the other two first pieces 50, the connecting body hole 431 of the second connecting member 40, the second through holes 61 of the four second pieces 60, and the third through hole 71 of the third piece 70. The first end 31 of the spring member 20 is engaged in the head slot 1121 of the locking member 10, and the second end 23 thereof is positioned in the connecting body cutout 435 of the second connecting member 40. The screw part 11 is engaged with the nut part 13, by screwing the threaded portion 1141 into the threaded hole 131. Therefore, the first connecting member 30 is rotatably secured to the second connecting member 40 by the locking member 10. The connecting body post 433 abuts the angled surface 333 of the positioning arm 332 of the second connecting member 30.

Figure 5:
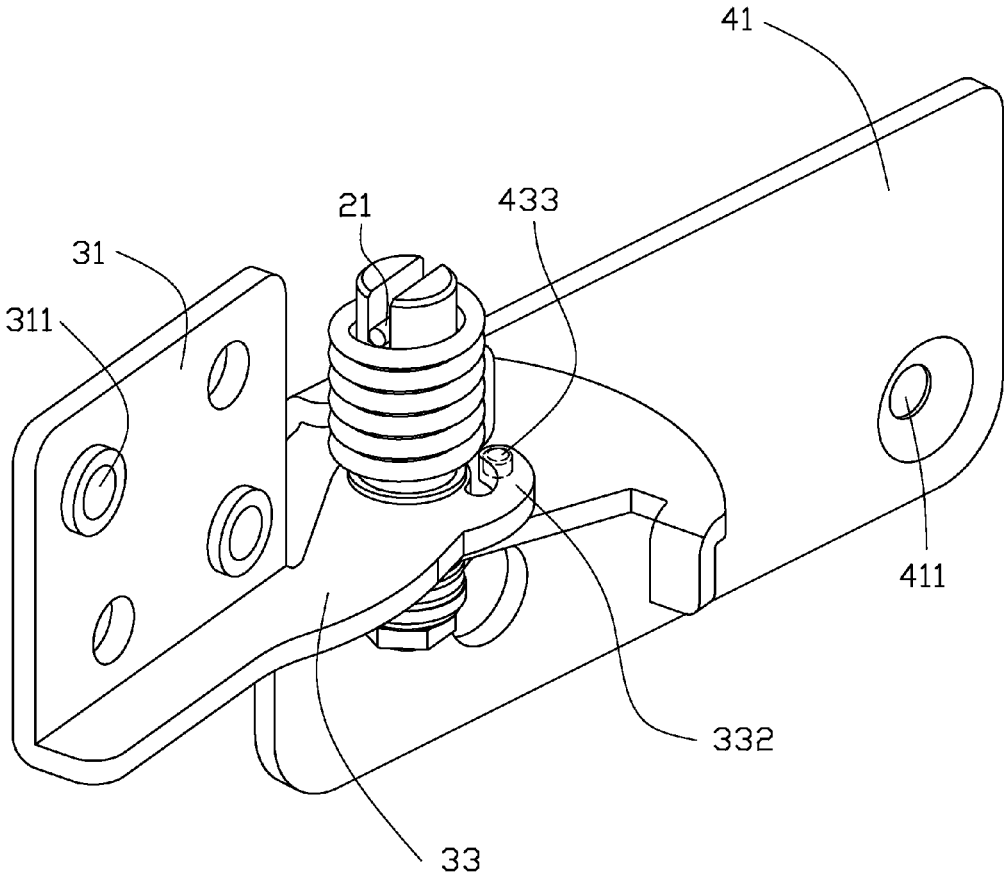
FIG. 5 is similar to FIG. 4, but shown from another aspect.
Figure 6:
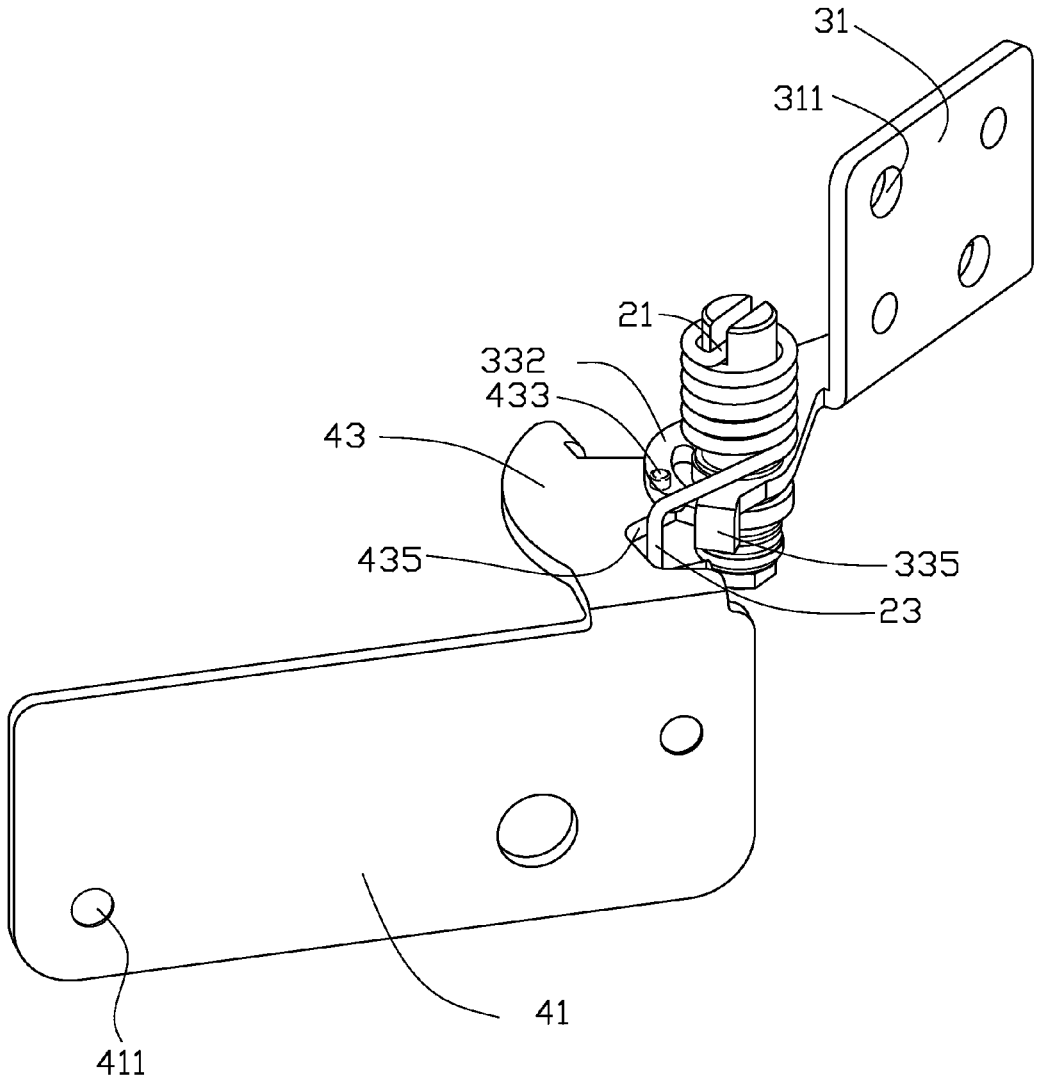
FIG. 6 is similar to FIG. 4, but showing the connecting body post in another position.

Referring to FIGS. 4-6, the first connecting member 30 is rotatable relative to the second connecting member 40 between a first position, where the connecting body post 433 is positioned at a start end of the positioning arm 332 connecting with the connecting portion 33, and a second position, where the connecting body post 433 is positioned at a distal end of the positioning arm 332. When the first connecting member 30 is in the first position, a distance between the distal end of the positioning arm 332 and the connecting body 43 is shorter than that between the start end of the positioning arm 332 and the connecting body 43. When the first connecting member 30 is rotated between the first and second positions, a first friction is generated between the start end of the positioning arm 332 and the positioning post 433, and a second friction is generated between the connecting body post 433 and the distal end of the positioning arm 332, which is greater than the first friction.

In the first position, the connecting portion tab 335 of the first connecting member 30 is moved out of the connecting cutout 435 of the second connecting member 40. The spring member 20 is resiliently deformed.

Referring to FIGS. 3-4, in the first position, the connecting portion tab 335 of the first connecting member 30 abuts an edge of the connecting cutout 435 of the second connecting member 40 to block the first connecting member 30 from further rotating relative to the second connecting member 40. The spring member 20 is in an original state.

When the first connecting member 30 is rotated between the first position and the second position, the locking member 10 is rotated with the first connecting member 30, so that torque is applied to the first end 21 of the spring member 20 to deform the spring member 20.

In one embodiment, the first connecting member 30 is configured to be secured to a display of an electronic device, and the second connecting member 40 is configured to be secured to a host of the electronic device. So, the display is rotatably connected to the host with the hinge device. The electronic device may be, for example, a notebook computer, a mobile telephone, or a smart telephone.

It is to be understood, however, that even though numerous characteristics and advantages have been set forth in the foregoing description of embodiments, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A hinge device comprising:

a first connecting member defining a connecting portion hole therein, a resiliently deformable positioning arm with an angled surface located on the first connecting member;

a second connecting member defining a connecting body hole therein, a connecting body post located on the second connecting member;

at least one spacer defining a through hole; and a locking member engaging in the connecting portion hole, the through hole and the connecting body hole so that the first connecting member is rotatable relative to the second connecting member;

wherein the connecting body post abuts on the angled surface of the positioning arm, the first connecting member is rotatable relative to the second connecting member between a first position where a first friction is generated between the connecting body post and the angled surface, and a second position where a second friction is generated between the connecting body post and the angled surface and greater than the first friction; and said at least one spacer is sandwiched between the first connecting member and the second connecting member.

2. The hinge device of claim 1, further comprising a spring member rotating the first connecting member relative to the second connecting member from the second position to the first position.

3. The hinge device of claim 2, wherein the spring member comprises a first end engaging with the locking member, and a second end engaging with the second connecting member.

4. The hinge device of claim 3, wherein the locking member defines a head slot receiving the first end of the spring member.

5. The hinge device of claim 3, wherein the second connecting member defines a connecting body cutout therein, and the second end of the spring member is engaged in the connecting body cutout.

6. The hinge device of claim 5, wherein the locking member is rotatable with the first connecting member, so that torque is applied to the first end of the spring member to deform the spring member when the first connecting member is rotated relative to the second connecting member.

7. The hinge device of claim 1, wherein a connecting portion tab is located on the first connecting member, and engageable with the second connecting member to block the first member from rotating relative to the second connecting member.

8. The hinge device of claim 1, wherein the locking member is rotatable with the first connecting member relative to the second connecting member.

9. The hinge device of claim 1, wherein the connecting portion hole is substantially rectangular; a part of the locking member is engaged in the connecting portion hole; and a cross section of the part is substantially rectangular so that the locking member is rotatable with the first connecting member.

10. A hinge device comprising:

a first connecting member comprising a base portion configured to be attached to a part of an electronic device, and a connecting portion located on the base portion; a resiliently deformable positioning arm located on the connecting portion;

a second connecting member comprising a base body configured to be attached to another part of the electronic device, and a connecting body located on the base body; a connecting body post located on the connecting body;

a locking member connecting the connecting portion with the connecting body so that the first connecting member is rotatable relative to the second connecting member; wherein the first connecting member is rotatable relative to the second connecting member between a first position, where the connecting body post engages with a first end of the positioning arm, and a second position where the connecting body post engages with a second end of the positioning arm; a distance between the first end of the positioning arm and the connecting body is smaller than that between the second end and the connecting body.

11. The hinge device of claim 10, further comprising a spring member rotating the first connecting member relative to the second connecting member from the second position to the first position.

12. The hinge device of claim 11, wherein the spring member comprises a first end engaging with the locking member, and a second end engaging with the second connecting member.

13. The hinge device of claim 12, wherein the locking member defines a head slot receiving the first end of the spring member.

14. The hinge device of claim 12, wherein the second connecting member defines a connecting body cutout therein, and the second end of the spring member is engaged in the connecting body cutout.

15. The hinge device of claim 14, wherein the spring member is resiliently deformable when the first connecting member is rotated relative to the second connecting member.

16. The hinge device of claim 10, wherein a connecting portion tab is located on the first connecting member, and engageable with the second connecting member to block the first member from rotating relative to the second connecting member.

17. The hinge device of claim 10, wherein the locking member is rotatable with the first connecting member relative to the second connecting member.

18. The hinge device of claim 17, wherein the connecting portion of the first connecting member defines a connecting hole for a part of the locking member engaging therein; the connecting portion hole is substantially rectangular; a cross section of the part of the locking member is substantially rectangular so that the locking member is rotatable with the first connecting member.

19. The hinge device of claim 10, wherein the positioning arm is arc-shaped.

20. A hinge device comprising:

a first connecting member defining a connecting portion hole therein, a resiliently deformable positioning arm with an angled surface located on the first connecting member;

a second connecting member defining a connecting body hole therein, a connecting body post located on the second connecting member;

a locking member engaging in the connecting portion hole and the connecting body hole so that the first connecting member is rotatable relative to the second connecting member; and a spring member;

wherein the connecting body post abuts on the angled surface of the positioning arm, the first connecting member is rotatable relative to the second connecting member between a first position where a first friction is generated between the connecting body post and the angled surface, and a second position where a second friction is generated between the connecting body post and the angled surface and greater than the first friction; the spring member rotates the first connecting member relative to the second connecting member from the second position to the first position.

* * * * *